United States Patent [19]

Shimizu

[11] 4,448,574

[45] May 15, 1984

[54] EXTRA-HIGH PRESSURE WATER PUMP

[75] Inventor: Sachio Shimizu, Tokyo, Japan

[73] Assignee: Aiko Engineering Co. Ltd., Tokyo, Japan

[21] Appl. No.: 342,413

[22] Filed: Jan. 25, 1982

[51] Int. Cl.[3] ..... F04B 21/04

[52] U.S. Cl. ..... 417/488; 417/541; 417/568

[58] Field of Search ..... 417/487, 488, 540, 541, 417/568, 534; 277/125, 177, 188 R; 92/153, 156

[56] References Cited

U.S. PATENT DOCUMENTS

| | | | |
|---|---|---|---|
| 1,829,451 | 10/1931 | McNab | 417/487 |
| 2,330,781 | 9/1943 | Langmyhr et al. | 92/153 X |
| 2,733,664 | 2/1956 | Saalfrank | 417/568 |
| 3,632,121 | 1/1972 | Wahlmark | 277/188 R |
| 3,767,215 | 10/1973 | Brown | 277/125 |
| 3,854,735 | 12/1974 | Maurer et al. | 277/188 R |

*Primary Examiner*—Leonard E. Smith
*Attorney, Agent, or Firm*—Parkhurst & Oliff

[57] ABSTRACT

An extra-high pressure water pump includes a cylinder barrel, a piston and a pair of double check valves. The piston is composed of a main piston and a lubricating oil piston. The lubricating oil piston has a double piston ring and is slidably mounted on an additional piston rod connected to the main piston head. Lubricating oil is filled in a lubricating oil room made between the main piston and the lubricating oil piston in the cylinder barrel. The pressure between the lubricating oil and water in the pump is naturally kept at the same level by sliding a position of the lubricating oil piston on the additional piston rod, so that a sudden imbalanced pressure between the lubricating oil and the water in the cylinder barrel does not break the lubricating oil piston.

The extra-high pressure water pump supplies extra-high pressured water to its small carriable water jet gun.

9 Claims, 7 Drawing Figures

EXTRA-HIGH PRESSURE WATER PUMP

BACKGROUND OF THE INVENTION

The present invention relates to an extra-high water pressure device and especially relates to an extra-high pressure water pump, which has an additional piston or lubricating oil piston, which is mechanically so simple and strong and provides necessary lubricating oil to a piston or main piston of the pump.

In general, a pump uses lubricating oil in the gap between the piston and the cylinder barrel in order to reduce friction thereinbetween. A low pressure water pump need not use lubricating oil because of low friction. However, lubricating oil is indispensable to the gap in case of an extra-high pressure water pump, since the friction at the gap thereinbetween is so high because the gap is so tight in order to prevent high pressured water in the cylinder barrel from leaking from the gap thereinbetween.

Extra-high pressure pushes water in the cylinder barrel of the pump into the gap. Consequently, lubricating oil in the gap is pushed out of the gap by the extra-high pressured water pushed into the gap, which causes the pump a high friction trouble.

A conventional extra-high pressure water pump has solved this high friction problem by utilizing a lubricating oil piston connected to the head of the main piston with an additional piston rod or lubricating oil piston rod. This is, the pump has a double piston comprising a main piston and a lubricating oil piston. The lubricating oil piston is connected to the main piston head with an additional piston rod. Therefore, the pump has an additional room or lubricating oil room between the lubricating oil piston and the main piston. Lubricating oil is pushed into the lubricating oil room by extra-high pressure as high as the water pressure in the pump. Hence, extra-high pressure of the lubricating oil in the lubricating oil room pushes back the extra-high pressured water, so that the main piston and the lubricating oil piston are prevented from the high friction problem.

A conventional extra-high pressure water pump, however, employs an external means to obtain extra high pressure to push lubricating oil into the lubricating oil room, which makes the pump complicated, bigger and expensive. And as a water hammer, a sudden pressure imbalance between water pressure and the lubricating oil pressure in the cylinder barrel breaks the lubricating oil piston, because the lubricating oil piston is firmly fixed to the additional rod projecting from the main piston head.

Of course, an ordinary extra-high water pump has not a serious water hammer problem since a worked material by water jet from a water jet gun is placed in a certain fixed distance from the water jet gun, which does not change a pressure load of the pump. Whereas, an extra-high pressure water pump with a handy carryable water jet gun has a serious water hammer problem, since the handy carryable water jet gun is moved to various worked materials during working. Consequently, distance between the handy carryable water jet gun and a worked material or load is always changed during working. Therefore, a sudden change of a worked material by moving of the gun gives a water hammer shock to the lubricating oil piston of the pump, which breaks the lubricating oil piston.

The less gap between a lubricating oil piston and a cylinder barrel that a pump has, the higher sealing the pump can obtain. However, the less gap between the lubricating oil piston and the cylinder barrel that the pump has, the higher friction therebetween the pump has. In order to solve the friction problem, a pump generally employs a piston ring. Since a piston ring for an extra-high pressure water pump is required higher sealing, the piston ring is required to seal gaps between the lubricating oil piston and the inner edge of the piston ring and between the cylinder barrel and the outer edge of the piston ring. Consequently, the pump has also a high friction problem between the gaps. Any prior art cannot solve this friction problem, whereas the present invention has solved this friction problem while keeping high sealing at the gaps by employing a double piston ring, which will be described in the detailed description of the invention herein.

A conventional extra-high pressure water pump employs a conventional check valve. Since the extra-high pressure water pump produces a high water pressure, the high water pressure is apt to pinch between a valve ball and a contact of the valve an impure monocular in water at the check valve. Since the pinched impure monocular between the valve ball and the valve contact keeps the check valve ajar, high pressured water from the pump leaks from the check valve. The present invention has also solved this leakage problem by employing a double check valve, which will be described in the detailed description of the invention herein.

The water-jet gun used with the extra-high water pump of the present invention is a small handy carryable gun as mentioned above. Therefore, this gun causes the above mentioned problem.

The extra-high pressure water pump used in the present invention has solved these problems.

BRIEF SUMMARY OF THE INVENTION (1) It is an object of the present invention to provide an extra-high pressure water device using an extra-high pressure water pump and a small handy carryable water jet gun.

(2) It is another object of the present invention to provide an extra-high pressure water pump having low friction between a piston and a cylinder barrel of the pump.

(3) It is a further object of the present invention to provide an extra-high pressure water pump having a double piston composed of a main piston and an additional piston or lubricating oil piston connected to the head of the main piston with an additional piston rod or lubricating oil piston rod.

(4) Another object of the present invention is to provide an extra-high pressure water pump having a lubricating oil piston slidably connected to the main piston head with the lubricating oil piston rod.

(5) It is a further object of the present invention to provide an extra-high pressure water pump having a double piston ring comprising an inner sealing ring, an outer sealing ring and a pusher therefor.

(6) It is a further object of the present invention to provide an extra-high pressure water pump having a pair of double check valves.

(7) Still further, it is another object of the present invention to provide an extra-high pressure water device having a small handy carryable water jet gun.

(8) An extra-high pressure water pump of the present invention comprises a cylinder barrel, a piston and a cylinder head. The piston is made with a double piston including a main piston and an additional piston or lubricating oil piston. The lubricating oil piston is slidably mounted on an additional piston rod or lubricating oil piston rod projecting from the head of the main piston.

Consequently an additional room or lubricating oil room is made between the main piston and the lubricating oil piston in the cylinder barrel. Lubricating oil is filled into the lubricating oil room. An imbalanced pressure between lubricating oil pressure in the lubricating oil room and water pressure in a water room made between the lubricating oil piston and top side of the cylinder barrel slides the position of the lubricating oil piston on the lubricating oil piston rod, so that it keeps the pressure between them always balanced.

The lubricating piston has a piston ring which is a double piston ring, which is composed of an outer sealing ring, an inner sealing ring and a pusher. Therefore, they can seal tightly and independently gap between the cylinder barrels and the lubricating oil piston, while providing a necessary play between the cylinder barrel and the lubricating oil piston.

The cylinder head has a pair of double check valves, one of which is used for intaking water and the other of which is used for pushing out pressured water. Both valves are of the same construction. The double check valve is made with two check valves connected in series, both valve checks being of the same construction.

The extra-high pressure water pump is used for a small handy carryable water jet gun, which comprises a housing, an electric motor, a weaving means and a nozzle head. The electric motor and the weaving means are installed in the housing. A driving power from the electric motor is changed into a weaving power by the weaving means which weaves the nozzle head.

(9) The various features of novelty which characterize the present invention are pointed out with particularity in the claims annexed to and forming a part of this specification. For a better understanding of the invention, its operating advantage, and specific objects attained by its use, reference should be made to the accompanying drawings and descriptive matter in which there are illustrations and preferred embodiments of the invention.

DETAILED DESCRIPTION OF THE INVENTION

A preferred embodiment of the present invention will now be described by way of example, by reference to the accompanying drawings.

Figure 1:
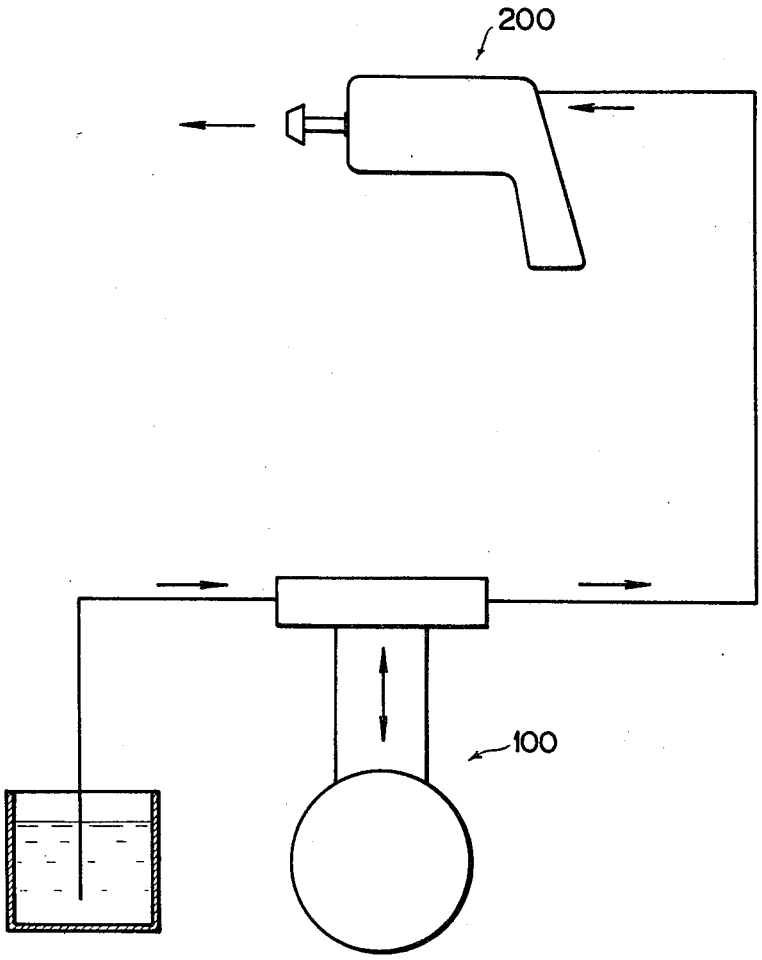
FIG. 1 is a schematic diagram of the extra-high pressure water device of the present invention.
Figure 2:
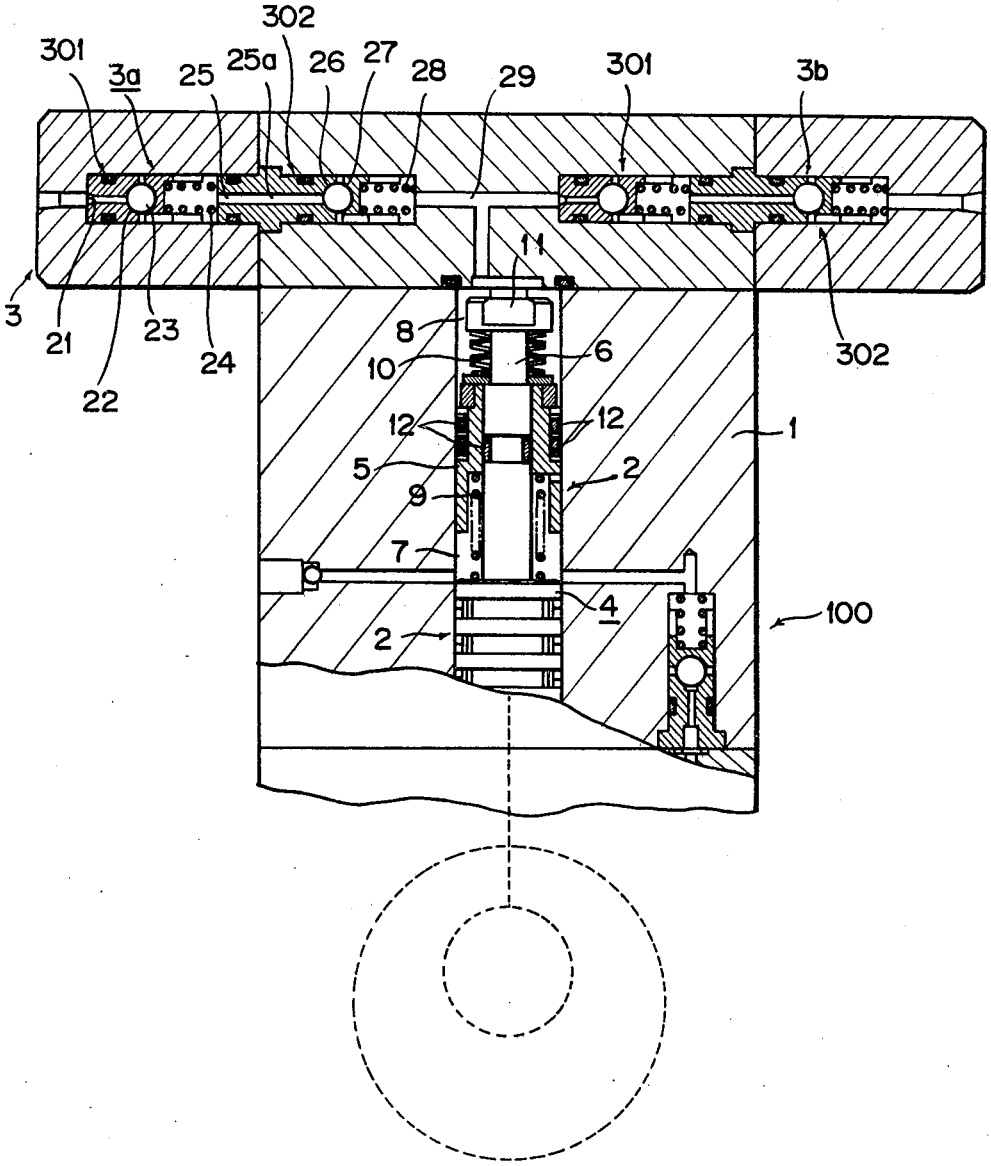
FIG. 2 is a vertical partial sectional view of the extra-high pressure water pump of the extra-high pressure water device.

The present invention comprises an extra-high pressure water pump 100 (FIG. 1), which is composed of a cylinder barrel 1, piston 2 and a cylinder head 3 as shwon in FIG. 2. The extra-high pressure water pump 100 has a small handy carryable water jet gun 200 as shown in FIG. 1.

The piston 2 is a double piston with a main piston 4 and an additional piston 5 as shown in FIG. 2. The additional piston or lubricating piston 5 is slidably mounted on an additional piston rod 6 projecting from the head of the main piston 4. Therefore, an additional room or lubricating oil room 7 is made between the main piston 4 and the lubricating oil piston 5 in the cylinder barrel 1 in addition to a water room 8 which is an ordinary piston room of an ordinary water pump. Lubricating oil is filled up in the lubricating oil room 7. A supporting spring coil 9 is put between the main piston 4 and the lubricating oil piston 5. And another supporting spring coil 10 is put between the lubricating oil piston 5 and a nut 11 fastened to the top part of the additional piston rod 6.

Since the double piston 2 is composed as mentioned above, the lubricating oil piston 5 can bear with a sudden imbalanced pressure between lubricating oil pressure in the lubricating oil room 7 and water pressure in the water room 8. Since a lubricating oil piston (5) of a conventional extra-high pressure water pump is fixed to an additional piston rod projecting from the main piston head, a sudden imbalanced pressure between lubricating oil pressure in the lubricating oil room and water pressure in the water room gives a strong shock to the lubricating oil piston as a water hammer, which breaks the lubricating oil piston.

Whereas, a sudden imbalanced pressure only pushes the lubricating oil piston to slide on the lubricating oil piston rod 6 since the extra-high pressure water pump used in the present invention employs the above mentioned slidable lubricating oil piston 5. Consequently, a sudden imbalanced pressure will not give the lubricating oil piston any water hammer shock that would cause it to break. And in normal operation the water pressure in the water room 8 pushes the lubricating oil piston 5 against the lubricating oil room 7 until lubricating oil in the lubricating oil room 7 obtains the same high pressure as the water pressure in the water room 8. It is easy to send lubricating oil into the lubricating oil room 7 when the pump intakes water because water pressure in the water room 8 at that time is zero or negative pressure. Therefore, the pump used in the present invention requires no additional external device which gives lubricating oil high pressure.

As mentioned above, the lubricating oil piston itself positions at a balanced pressured position. The supporting spring coils 9 and 10 help the lubricating oil piston move to the balanced center position when the lubricating oil piston recovers from the position where the lubricating oil piston was positioned by a sudden imbalanced pressure.

The lubricating oil piston has a piston ring which is a double piston ring 12.

Figure 3:
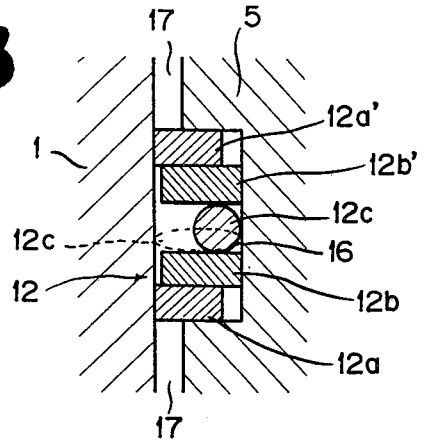
FIG. 3 is a vertical partial sectional view about the piston ring of the extra-high pressure vapor pump.

FIG. 3 shows a partial enlarged view of FIG. 2. In FIG. 3, a piston ring groove 16 is made in the lubricating oil piston 5, wherein a piston ring or double piston ring 12 is fit. The double piston ring 12 comprises an outer sealing piston ring 12*a*, an inner sealing piston ring 12*b* and a pusher 12*c*. The outer sealing piston ring 12*a* seals the outer part of the gap 17 between the cylinder barrel 1 and the lubricating oil piston ring 5, and the inner sealing piston ring 12b seals the inner part of the gap 17, and the piston rings 12a and 12b are contacted each other to seal the gap between the rings 12a and 12b as shown in FIG. 3. The pusher pushes the inner sealing piston ring 12b against the outer sealing piston ring 12a so that the gap between the two rings 12a and 12b is sealed.

It is possible to use another pair of an outer sealing piston ring 12a' and an inner sealing piston ring 12b' in order to obtain better sealing as shown in FIG. 3 of this embodiment of the present invention. In this case, the pusher 12c is placed between the two pair of the piston rings 12a, 12b and 12a', 12b'.

The outer sealing piston ring 12a (12a') must be made of a rigid material such as metal so that it will not be bent into the gap 17 between the cylinder barrel 1 and the lubricating oil piston 5. The outer sealing piston ring 12a must also have a wider hole than the inner diameter of the piston ring groove 16 so that it can obtain a clearance or play. However, it is possible that the inner sealing piston ring 12b (12b') be made of softer material such as Teflon since the inner sealing piston ring 12b is held by the outer sealing piston ring 12a. In this case, it is possible that outer diameter of the inner sealing piston ring 12b is as large as the inner diameter of the cylinder barrel 1 since a soft material is flexible and is capable of play. However, if the inner sealing piston ring 12b is made of a rigid material, the outer diameter of the ring 12b must be smaller than the inner diameter of the cylinder barrel 1 in order to obtain the same kind play.

The pusher must be made of an elastic material such as rubber so that it pushes the inner sealing piston ring 12b against the outer sealing piston ring 12a. When the pusher 12c is pinched between the piston rings 12b and 12b' by lubricating oil pressure or water pressure in the pump 100, the pusher 12c will be expanded by the pressure as illustrated in dotted line in FIG. 3. Consequently, the pusher will also seal the gap 17 between the cylinder barrel 1 and the piston ring groove 16.

In FIG. 2, the cylinder head 3 is shown, wherein two check valves 3a and 3b are seen, one (3a) of which is used for intaking water, and the other (3b) of which is used for pushing out pressured water. Both of the check valves 3a and 3b are the same construction, which is a double check valve. The double check valve 3a (3b) is composed of a first check valve 301 and a second check valve 302, which are the same construction. The check valve 301 (302) comprises an intake opening 21, a valve contact 22, a valve ball 23, a spring coil 24, an outlet opening 25, an intake opening 25a, a valve contact 26, a valve ball 27, a spring coil 28 and an outlet opening 29, which are connected in this order in series.

Figure 4:
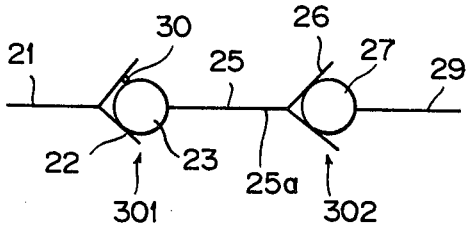
FIG. 4 is a block diagram of the check valve of the pump showing the first valve with a particle problem.

FIGS. 2, 3 and 4 show how to work the double check valve 301 (302). Water flows from the first intake opening 21 to the second output opening 29 pushing the valve balls 23 and 27 against the spring coils 24 and 28 so that the contacts 22 and 26 are opened. If an impure monocular 30 in the water in the check valve 3a is pinched between the contact 22 and the valve ball 23 as illustrated in FIG. 4 when the jump pushes out pressured water, the second check valve 302 closes the water circuit while the first check valve 301 is open because of the pinched impure monocular 30. Therefore, the water in the output opening or outlet opening 25 and the inlet opening 25a flows out through the open check valve 301. Consequently, water pressure P2 in the outlet opening 25 and the intake opening 25a reduces into the same level as water pressure P1 in the other intake opening 21. Therefore, the pressure in the valve 301 (302) is;

$$P1=P2<P3$$

Since the valve ball 23 now receives no more water pressure to pinch the impure monocular 30 by, the valve ball 23 lets the impure monocular 30 leave from the contact 22 by help of water flowing power. Consequently, the check valve 301 works properly again.

Meanwhile, even if the first check valve 301 does not work properly because of the impure monocular 30, the second check valve 302 works properly in order to keep the water pressure P3, high at the outlet opening or output opening 29. Therefore, preventing the water from flowing backwards.

Figure 5:
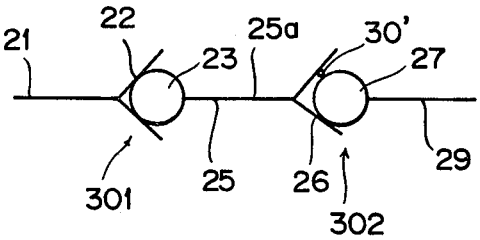
FIG. 5 is a block diagram of the check valve of the pump showing the second valve with a particle problem.

In FIG. 5, though the second check valve 302 does not work properly because of a pinched impure monocular 30', the first check valve 301 works properly. Hence, water pressure P2 at the first outlet opening or output opening 25 is kept as high as water pressure P3 at the outlet opening 29 with the first check valve 301. Consequently, the impure monocular 30' can easily leave from the second valve contact 26. The water pressure P1 at the first intake opening 21 is low. Therefore, the pressure in the double check 301 (302) is;

$$P2<P2=P3$$

Figure 6:
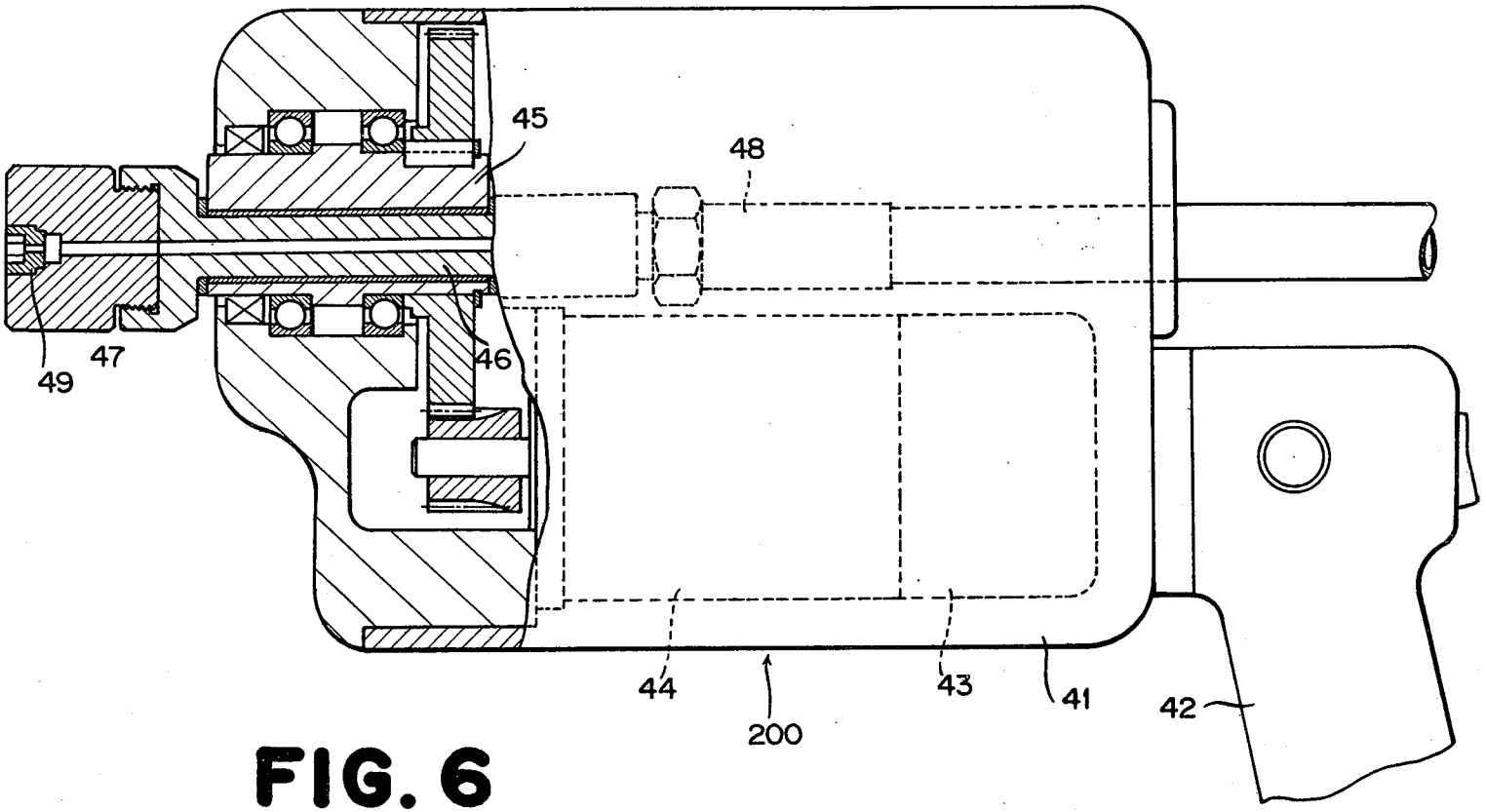
FIG. 6 is a side partial sectional view of the carryable water jet gun of the extra-high pressure water device.

FIG. 6 illustrates the small handy carryable water jet gun 200, which comprises a housing 47, a grip 42, a motor 43, a gear box 44, an eccentric driving shaft 45, an eccentric driven pipe 46, a nozzle head 47 and a flexible hose 48.

A driving power from the motor 43 through the gear box 44 drives the eccentric driving shaft 45. Since the driven pipe 46 is rotatably and eccentrically mounted in the driving shaft 45, the eccentric driven pipe 46 revolves not on its own axis but on the axis of the eccentric driving shaft 45 when the driving shaft 45 drives. Therefore, the nozzle head attached to the driven pipe 46 is revolved not on its own axis but on the axis of the driving pipe 46, and the flexible hose 48 is not twisted when the eccentric driving shaft revolves.

Extra-high pressured water from the extra-high pressure pump flows into the eccentric driven pipe 46 through the flexible hose 48. The water is discharged from a nozzle 49 of the nozzle head 47.

Figure 7:
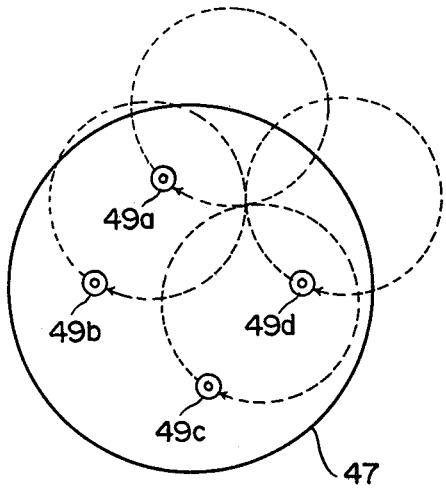
FIG. 7 is a front view of a nozzle head of another embodiment of the water jet gun.

FIG. 7 illustrates a front view of a nozzle head (47) of another embodiment of the water jet gun 200 of the present invention, wherein four nozzles 49a, 49b, 49c and 49d are employed. The dotted lines are orbits of discharging water from the nozzles 49a, 49b, 49c and 49d. The numbers and/or positions of the nozzles of the water jet gun 200 are not limited to ones illustrated in FIGS. 6 and 7.

The positions of the above mentioned outer sealing piston ring 12a and inner sealing piston ring 12b may be changed.

What is claimed is:

1. An extra high pressure water pump comprising:

a cylinder barrel;

a cylinder head extending across one end of said cylinder barrel;

a double piston in said cylinder barrel comprising;

a main reciprocally driven piston;

a piston rod rigidly secured to and projecting from the main piston;

an additional lubricating oil piston slidable over an additional piston rod;

a lubricating oil chamber in said barrel between said main piston and said additional lubricating oil piston;

a water chamber in said barrel between said lubricating oil piston and said one end of said cylinder barrel.

2. An extra high pressure water pump comprising:

a cylinder barrel;

a cylinder head extending across one end of said cylinder barrel;

a double piston within said cylinder barrel comprising;

a main reciprocality driven piston;

a piston rod rigidly secured to and projecting from the main piston;

an additional lubricating oil piston slidable over said piston rod;

a lubricating oil chamber in said barrel between said main piston and said additional lubricating oil piston;

a water chamber in said barrel between said lubricating oil piston and said one end of said cylinder barrel;

a plurality of supporting springs within said water chamber for centering said lubricating oil piston; and a double piston ring between said cylinder barrel and said lubricating oil piston.

3. An extra high pressure pump comprising:

a cylinder head;

a cylinder head extending across one end of said cylinder barrel;

a double piston in said barrel, said double piston comprising:

a main piston and a secondary piston;

an oil lubricating chamber in said barrel between said main and said secondary pistons;

a water chamber within said cylinder barrel between said secondary piston and said cylinder head;

a plurality of supporting spring coils within said water chamber;

means for sealing between the oil lubricating piston and the cylinder barrel;

means for sealing between the main piston and the cylinder barrel; and a water jet gun with conduit means fluidly connecting said gun to said cylinder head.

4. An extra high pressure water pump comprising:

a cylinder barrel;

a cylinder head extending across one end of said cylinder barrel;

a double piston in said cylinder barrel comprising;

a main reciprocally driven piston;

a piston rod rigidly secured to, projecting from and movable with the main piston;

an additional lubricating oil piston slidable over said piston rod;

a lubricating oil chamber in said barrel between said main piston and said additional lubricating oil piston;

a water chamber in said barrel between said lubricat ing oil piston and said one end of said cylinder barrel;

a plurality of supporting springs surrounding said piston rod within said water chamber and abutting said lubricating oil piston;

a double piston ring between said cylinder barrel and said lubricating oil piston;

said double piston ring comprising a pair of outer sealing piston rings, a pair of inner sealing piston rings, and a pusher between the inner sealing piston rings for pushing said inner sealing piston rings against said outer sealing piston rings to seal the said inner rings against said outer rings;

two pair of double check valves within the cylinder head, each pair of check valves including means for intaking water thereinto and means for releasing pressurized water therefrom; and a hand-held water jet gun with conduit means fluidly connecting said gun to said cylinder head.

5. An extra high pressure water pump comprising:

a cylinder barrel;

a cylinder head extending across one end of said cylinder barrel;

a double piston within said cylinder barrel, and double piston comprising;

a main reciprocally driven piston;

a piston rod rigidly secured to, projecting from, and reciprocally moveable with said main piston;

an additional lubricating oil piston slidable over said additional piston rod;

a lubricating oil chamber in said cylinder barrel between said main piston and said lubricating oil piston;

a water chamber in said cylinder barrel between said lubricating oil piston and said one end of said cylinder barrel; and a hand-held water jet gun with conduit means fluidly connecting said gun to said cylinder head.

6. An extra-high pressure water pump as claimed in claim 5, comprising a double piston ring with means for sealing between said lubricating oil piston and said cylinder barrel.

7. An extra high pressure water pump as claimed in claim 5, further comprising a pair of supporting springs in said water chamber, said springs holding said additional lubricating oil piston in a balanced centered position in said water chamber.

8. An extra high pressure water pump as claimed in claim 5, wherein said cylinder head contains two pair of double check valves, one valve of each of said pairs having means for admitting fluid, and the other valve of each of said pairs having means for releasing fluid.

9. An extra high pressure water pump as claimed in claim 8, wherein each valve of each pair of double check valves comprises;

an inlet opening, a valve contact, a valve ball, a spring coil, an outlet opening, a second inlet opening, a second valve contact, a second valve ball, a second spring coil, and a second outlet opening connected in series.

* * * * *